United States Patent [19]

Gorzegno

[11] 4,294,200

[45] Oct. 13, 1981

[54] VARIABLE PRESSURE VAPOR GENERATOR UTILIZING CROSSOVER CIRCUITRY FOR THE FURNACE BOUNDARY WALL FLUID FLOW TUBES

[75] Inventor: Walter P. Gorzegno, Morristown, N.J.

[73] Assignee: Foster Wheeler Energy Corporation, Livingston, N.J.

[21] Appl. No.: 100,770

[22] Filed: Dec. 6, 1979

[51] Int. Cl.[3] ..... F22B 27/04

[52] U.S. Cl. ..... 122/406 S

[58] Field of Search ..... 122/235 S, 406 S, 406 ST, 122/448 S, 406 R, 451 S

[56] References Cited

U.S. PATENT DOCUMENTS

| | | | |
|---|---|---|---|
| 3,343,523 | 9/1967 | Gorzegno et al. | 122/406 S |
| 3,556,059 | 1/1971 | Gorzegno et al. | 122/406 S |
| 3,789,806 | 2/1974 | Gorzegno | 122/406 R |
| 3,872,836 | 3/1975 | Gorzegno et al. | 122/406 S |
| 4,116,168 | 9/1978 | Gorzegno et al. | 122/406 S |

*Primary Examiner*—Edward G. Favors

*Attorney, Agent, or Firm*—Marvin A. Naigur; John E. Wilson; John J. Herguth, Jr.

[57] ABSTRACT

A vapor generator including an enclosure defined by front wall or rear wall and two sidewalls with each of the walls being formed by a plurality of interconnected fluid flow tubes. Fluid is passed initially through the entire length of at least one of the sidewall sections and then simultaneously through the front wall, the rear wall and the other sidewall sections. Crossover circuitry is provided for transferring the fluid from area of each wall to another area thereof to achieve even heat pick-up.

6 Claims, 10 Drawing Figures

MCR LOAD

STEAM AND WATER
TEMPERATURE - ENTHALPY DIAGRAM

VARIABLE PRESSURE VAPOR GENERATOR UTILIZING CROSSOVER CIRCUITRY FOR THE FURNACE BOUNDARY WALL FLUID FLOW TUBES

BACKGROUND OF THE INVENTION

This invention relates to a vapor generator, and more particularly, to a sub-critical or super-critical once-through generator operating at variable pressure for converting water to steam.

The trend in the generation of electrical power is to the use of large fossil fired vapor generators to maintain the cyclic or peaking load requirements of a utility's distribution system. This type of use dictates that these type generators be capable of rapid load changes on line. For example, a utility distribution system may require from the steam generator as much as 3% per minute load change capability, and in some instances a load change rate as high as 5% to 10% per minute. Also the large steam generators must be able to achieve rapid warm starts following overnight or weekend shutdown.

It is well recognized that rapid load changes of the above type from the point of view of turbine life can best be accomplished by operating the vapor generator at variable pressure since variable throttle pressure operation with full arc admission for the turbine produces minimal change to the first stage temperature and therefore can accommodate rapid load changes with minimum turbine rotor damage.

An additional advantage of variable pressure operation is that during cold and hot starts for the vapor generator, close matching of fluid temperature to turbine metal temperature is more easily achieved to limit fatigue damage to turbine inlet parts.

However, a once-through vapor generator designed for variable pressure operation must maintain satisfactory characteristics of flow in the furnace circuitry and minimize circuit flow unbalance caused by heat upset or uneven distribution of steam and water to a circuit.

U.S. Pat. No. 3,789,806 issued on Feb. 5, 1978, to the present applicant and assigned to the same assignee as the present invention, teaches the use of a once-through vapor generator capable of variable pressure operation in which the functional performance of the furnace circuitry at different loads and pressures was satisfactory to overcome the above disadvantages. In this arrangement, and particularly the arrangement disclosed in the embodiment of FIGS. 9 and 10, initial flow of fluid through the furnace circuitry was through the lower portions of the furnace boundary sidewalls. The fluid was then passed to mix headers and then simultaneously through the front wall, the rear wall and the sidewall end panels before passing through the upper sidewall portions. However, in this arrangement, the horizontal span of the lower sidewall portions through which the fluid was initially passed was large and to limit the enthalpy pick-up of this circuit an intermediate mix header was used. The use of the mix header is undesirable from a sealing and maintenance aspect, and is costly.

SUMMARY OF THE INVENTION

It is therefore an object of the present invention to provide a once-through vapor generator capable of variable pressure operation in which the functional performance of the furnace circuitry at different loads and pressures is such that satisfactory flow characteristics in the furnace circuitry are maintained to avoid excess temperature differentials or overheating of the boundary wall tubes.

It is a further object of the present invention to provide a once-through vapor generator of the above type in which the above advantages are achieved while avoiding the necessity of mix headers in the sidewall portions of the furnace boundary walls defining the first fluid pass.

It is a still further object of the present invention to provide a vapor generator of the above type in which cross-over circuitry is provided to compensate for heat unbalances in the tubes forming the furnace boundary walls.

Toward the fulfillment of these and other objects, the generator of the present invention is formed by a plurality of fluid flow tubes interconnected in a manner to form the boundary walls of an enclosure. Fluid is passed initially through the entire length of at least one of the sidewall sections and then in parallel through the front wall, the rear wall and the other sidewall sections. Cross-over circuitry is associated with the front wall, the rear wall and the other sidewall sections for transferring the fluid from one area of the front wall, the rear wall and the other sidewall sections to another area thereof.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figures 1, 2:
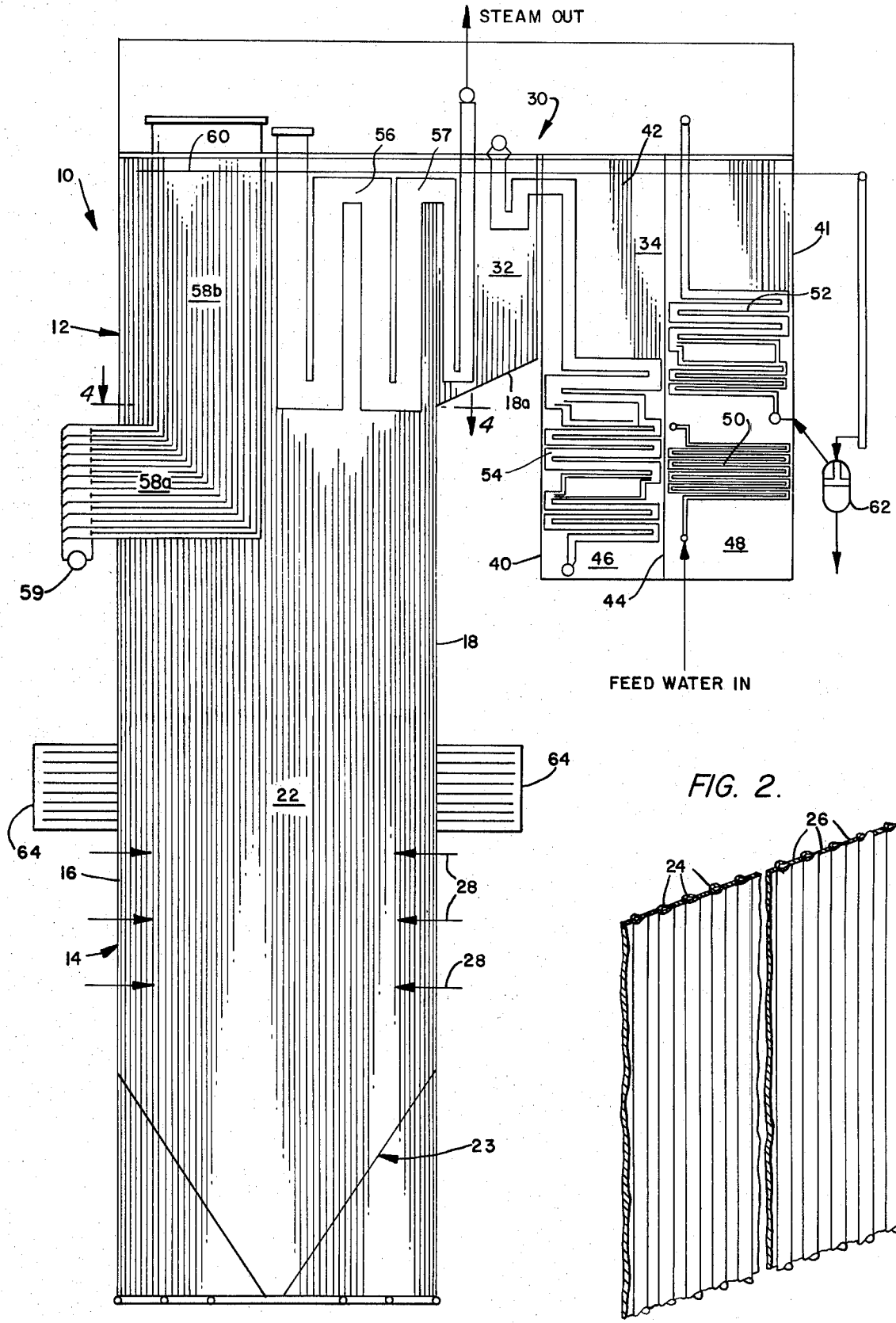
FIG. 1 is a schematic-vertical sectional view of the vapor generator of the present invention.
FIG. 2 is an enlarged partial perspective view depicting a portion of a furnace boundary wall of the vapor generator of the present invention.

Referring specifically to FIGS. 1–4 of the drawings, the reference numeral 10 refers in general to the vapor generator of the present invention and includes an upper furnace section 12 and a lower furnace section 14. The boundary walls defining the furnace sections 12 and 14 include a front wall 16, a rear wall 18 and two sidewalls 20 and 22 extending between the front and rear walls. The lower portions of the front wall 16 and the rear wall 18 are sloped inwardly to form a hopper section 23 at the lower furnace section 14 for the accumulation of ash, and the like, in a conventional manner.

As better shown in FIG. 2, each of the walls 16, 18, 20 and 22 are formed of a plurality of tubes 24 having continuous fins 26 extending outwardly from diametrically opposed portions thereof, with the fins of adjacent tubes being connected together in any known manner, such as by welding, to form a gas-tight structure. The tubes 24 forming the walls 16, 18, 20 and 22 extend vertically from the lower end of the lower furnace section 12 to the upper end of the upper furnace section 14 with the exception of a portion of the tubes in the rear wall 18 which are bent out of the plane of the latter wall in the upper furnace section to form a branch wall 18*a*.

Figure 3:
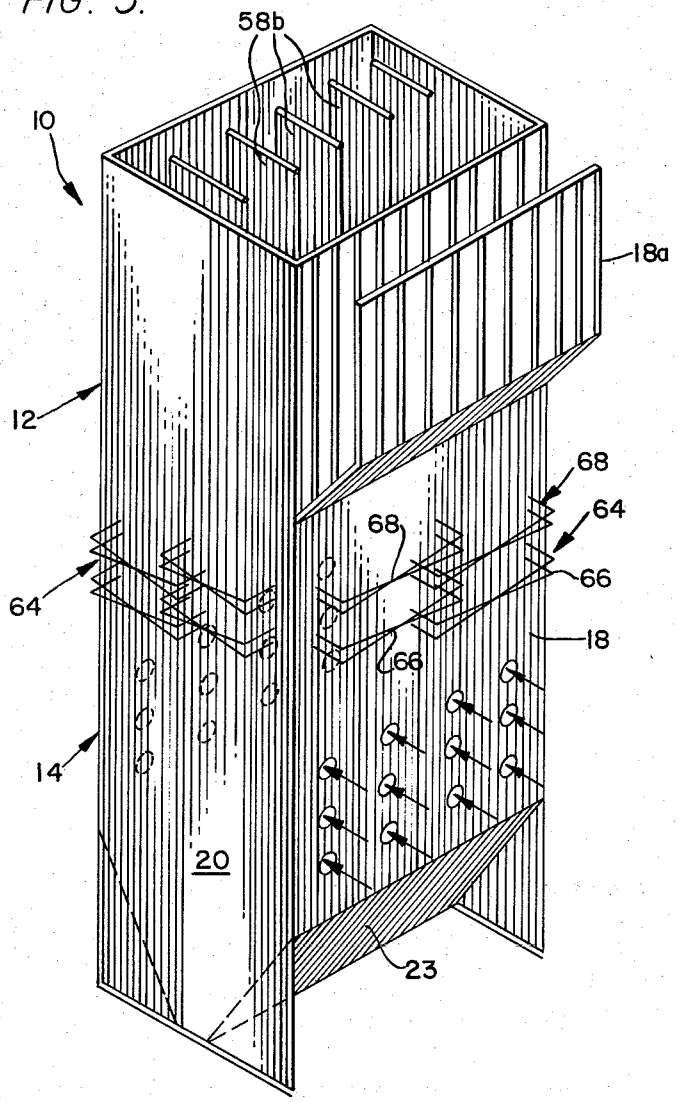
FIG. 3 is a reduced partial perspective view of a portion of the vapor generator of FIG. 1.

As shown in FIGS. 1 and 3, the branch wall 18*a* is formed by bending a selected number of tubes 24 from the rear wall 18 outwardly to form an angular portion and then upwardly to form a vertical portion. As a result, spaces are defined between the remaining tubes 24 in the upper portion of the rear wall 18 as well as between the portions of the tubes forming the vertical portion of the branch wall 18*a*. This permits combustion gases to exit from the upper furnace section 14 as will be described later.

A plurality of burners 28 are disposed in the front and rear walls 16 and 18, respectively, in the lower furnace section 14, with the burners being arranged in this example in four vertical rows of three burners per row. The burners 28 are shown schematically since they can be of a conventional design.

Referring again to FIG. 1, a heat recovery area, shown in general by the reference numeral 30, is provided adjacent the upper furnace section 12 in gas flow communication therewith, and includes a vestibule section 32 and a convection section 34. The floor of the vestibule section 32 is formed by the angular portion of the branch wall 18*a* with the tubes 24 in this portion being provided with fins which are connected to fins of adjacent tubes to render the floor gas-tight. The remaining portions of the tubes 24 forming the vertical portion of the branch wall 18*a* extend in a spaced relation to permit gases to pass from the vestibule section 32 to the convection section 34.

The heat recovery area 30 includes a front wall 40, a rear wall 41 and two sidewalls 42, with one of the latter being shown in FIG. 1. The upper portion of the front wall 40 is formed by a plurality of tubes extending in a spaced relationship to permit the gases from the vestibule section to enter the convection section. The rear wall 41, the sidewalls 42, and the lower portion of the front wall 40 are formed of a plurality of vertically extending, finned, interconnected tubes 24 in a manner similar to that described above.

A partition wall 44, also formed by a plurality of finned, interconnected tubes 24, is provided in the heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule section 32 in direct fluid communication with the platen superheater 56.

The upper end portions of the walls 16, 18, 20 and 22, and the branch wall 18*a*, as well as the partition wall 44, the sidewalls 42 and the rear wall 41 of the heat recovery area 30 all terminate in substantially the same general area in the upper portion of the vapor generating section 10.

A plurality of division walls are provided, with each wall having a horizontal portion 58*a* and a vertical portion 58*b*. Each wall 58 is formed by a plurality of tubes interconnected with spaced welded ties. The tubes forming the horizontal portions 58*a* of the walls 58 extend from a header 59 located externally and adjacent to the front wall 16 and penetrate the latter wall before they are bent upwardly to form the vertical portions 58*b*. The upper ends of the vertical portions 58*b* terminate in substantially the same general area as the walls 16, 18, 20 and 22. It is understood that a welded seal (not shown) is provided for the area of penetration of the front wall 18 by the horizontal division wall portions 58*a*. Since the specific construction of the division walls 58 and the sealing assembly does not, per se, form any part of the present invention they will not be described in any further detail.

A roof 60 is disposed in the upper portion of the section 10 and consists of a plurality of tubes 24 having fins 26 connected in the manner described above but extending horizontally from the front wall 16 of the furnace section to the rear wall 41 of the heat recovery area 30.

It can be appreciated from the foregoing that combustion gases from the burners 28 in the lower furnace section 14 pass upwardly to the upper furnace section 12 and through the heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

As shown in FIG. 1, a plurality of separators 62 are disposed in a parallel relationship adjacent the rear wall 41 of the heat recovery area 30 in the main flow circuit between the roof 60 and the primary superheater 52. During start-up the separators 62 operate in a known manner to separate the fluid from the roof 60 into a liquid and vapor. The vapor from the separators 62 is passed directly to the primary superheater 52 and the liquid can be passed to a drain manifold and heat recovery circuitry for further treatment. For on line operation single phase fluid passes through the separators to the primary superheater 52.

Although not shown in the drawings for clarity of presentation, it is understood that suitable inlet and outlet headers, downcomers and conduits, are provided to place the tubes 24 of each of the aforementioned walls, separators, and heat exchangers as well as the roof 60 in fluid communication to establish a flow circuit that will be described in detail later.

Figure 4:
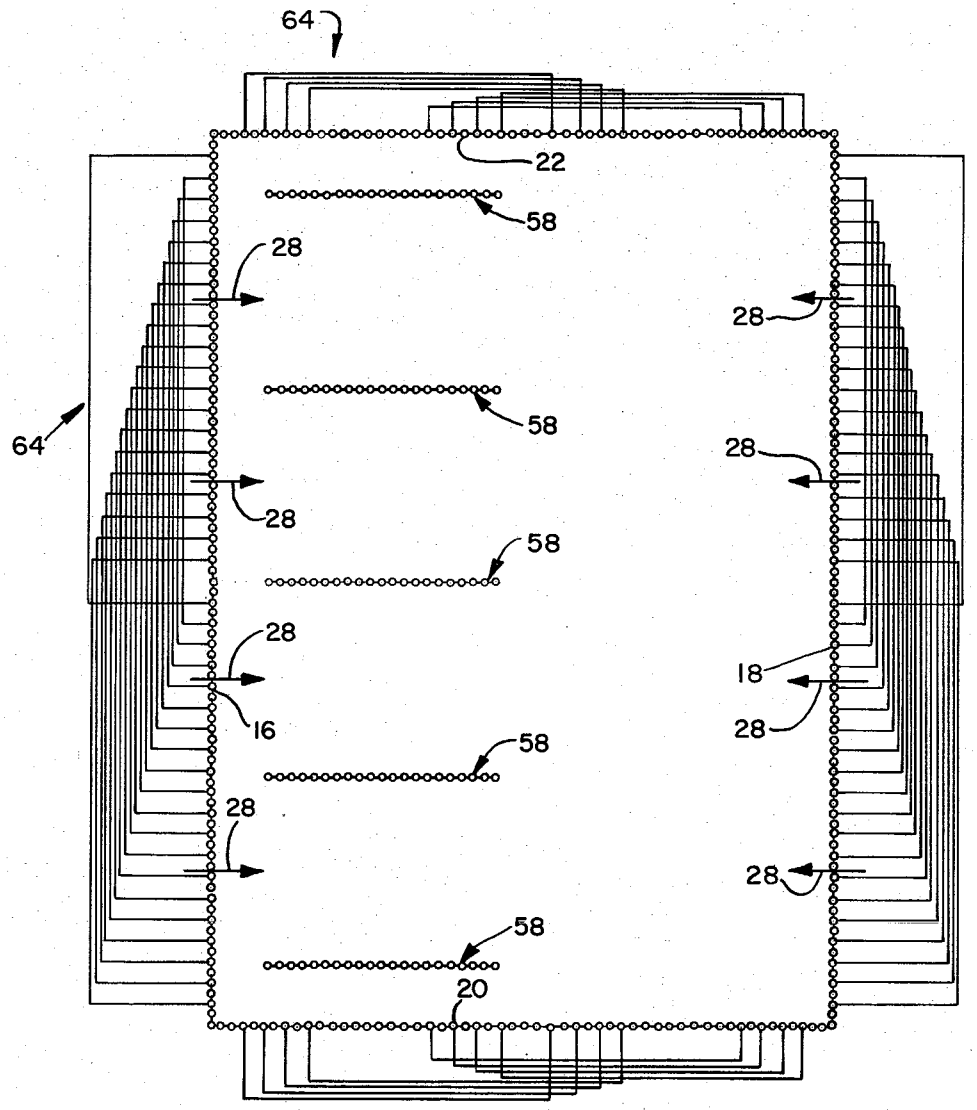
FIG. 4 is a cross-sectional view taken along the line 4—4 of FIG. 1.

As shown in general FIGS. 1, 3 and 4, a crossover circuitry, shown in general by the reference numeral 64, is provided for each wall 16, 18, 20 and 22 and is located in an area slightly above the location of the burners 28 with respect to the walls 16 and 18 and in a similar vertical location with respect to the walls 20 and 22. The crossover circuitry 64 is designed to transfer fluid from one area of the particular wall to another area thereof which has different exposure to the heat in order to correct for unbalances of heat pickup by the fluid passing through the various tubes of the wall due to the differences in location of the wall areas relative to the burners 28, uneven ash coverage, unbalanced firing of the burners, etc. To this end, and referring to FIGS. 5 and 6 which depict a portion of the wall 16, the crossover circuitry 64 includes a plurality of horizontally extending U-shaped tubes 66 which extend from one portion 16*a* to another portion 16*b* of the wall 16. Each tube 66 is connected at one end to a tube 24 of the wall portion 16*a* and at the other end to another tube 24 forming the wall portion 16*b*. As noted in FIG. 6, due to space requirements, every other tube 24 from the wall portion 16*a* and 16*b* is connected by a horizontal crossover tube 66, it being understood that the tubes not so connected in FIGS. 5 and 6 will be connected by additional crossover circuitry at a level just above the level of the crossover circuitry shown in the drawings. For the purposes of example, a tube from the wall portion 16*a* has been given the designation 24*a*, a tube from the wall portion 16*b* has been given the designation 24*b* and two tubes forming the crossover circuitry have been given the designations 66*a* and 66*b*. It is noted that the crossover tube 66*a* connects a lower portion of the tube 24*a* of the wall portion 16*a* to an upper portion of the tube 24*b* of the wall portion 16*b*. In a similar manner the crossover tube 66*b* connects the lower portion of the tube 24*b* of the wall portion 16*b* to the upper portion of the tube 24*a* of the wall portion 16*a*. In this manner, and assuming the wall portion 16*b* has a different exposure to the heat than the wall portion 16*a*, the difference in heat pickup by the water passing through the tube will be substantially equalized.

Figure 5:
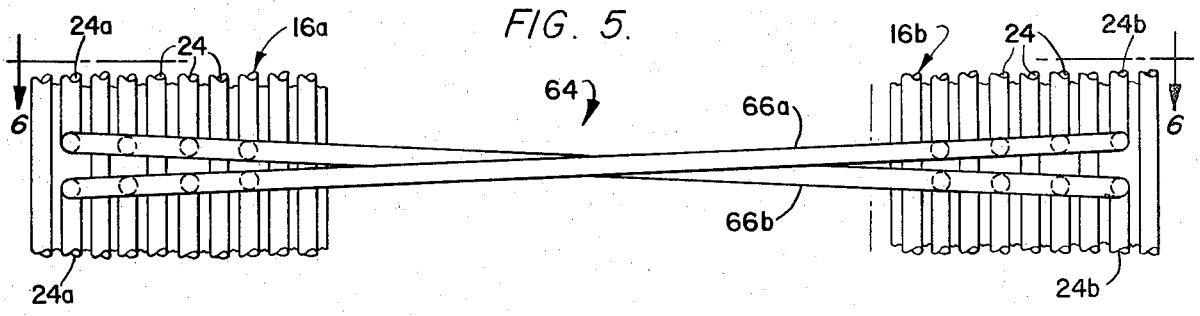
FIG. 5 is a partial, enlarged, front elevational view of the vapor generator of FIG. 1.
Figure 6:
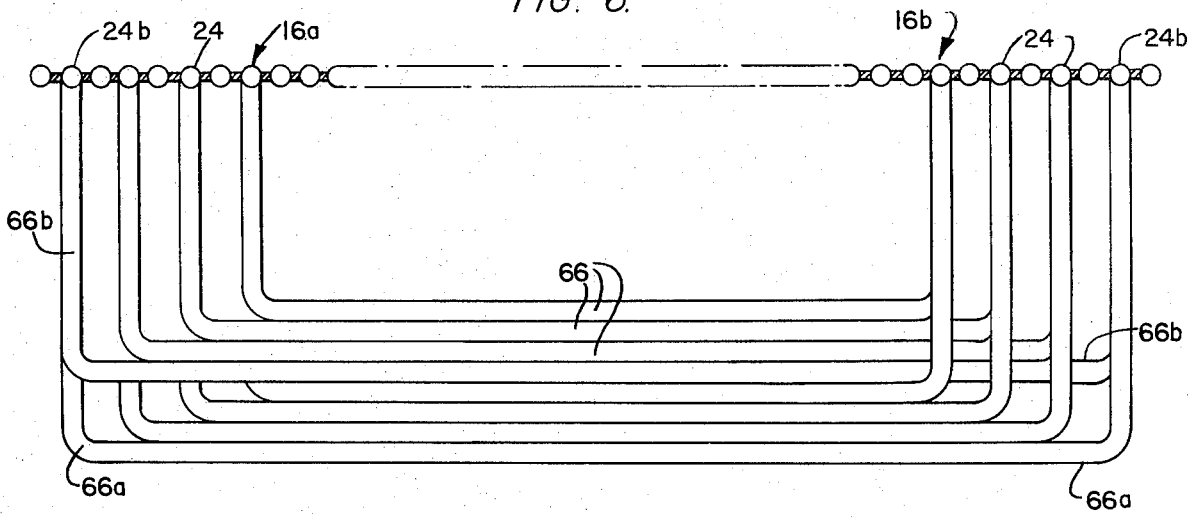
FIG. 6 is a sectional view taken along the line 6—6 of FIG. 5.

As stated above, the alternate tubes 24 not crossed over by the crossover circuitry 66 in the examples of FIGS. 5 and 6 will be crossed over with another tube in another wall portion at a level just above the level of the crossover circuitry 66. This additional crossover circuitry is shown schematically in FIG. 3 by the reference numeral 68, it being understood that only a portion of the crossover circuitry 64 and 68 associated with the walls 18 and 20 is shown in FIG. 3 for clarity of presentation.

Figure 7:
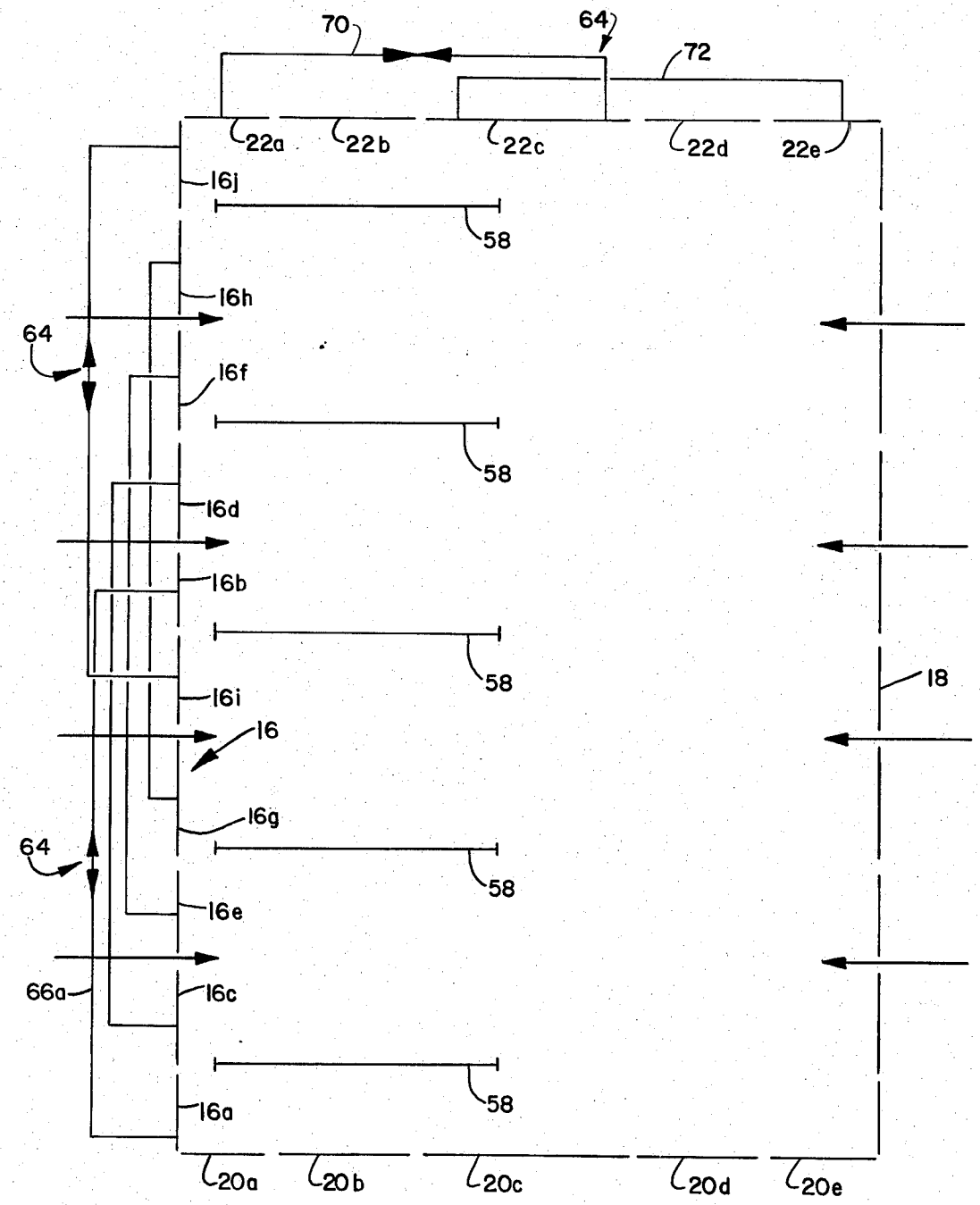
FIG. 7 is a schematic diagram depicting the boundary wall sections and the fluid flow circuitry of the vapor generator of the present invention.

The specific application of the crossover circuitry 64 to the front wall 16 is shown in greater detail in FIG. 7. In particular, the wall 16 has been divided into wall portions 16*a*–16*j* with a slight separation being shown between each wall portion for the purpose of illustration only, it being understood that in actual practice the wall will be continuous without such a break to insure gas tightness. The crossover tube 66*a* connecting a tube 24 of the wall portion 16*a* with a tube 24 of the wall portion 16*b* is shown schematically along with additional crossover tubes 66 interconnecting the tubes of wall portions 16*c* and 16*d*, the wall portions 16*e* and 16*f*, the wall portions 16*g* and 16*h*, and the wall portions 16*i* and 16*j*. Although the schematic representation shown shows only one crossover tube 66 extending between the two wall portions, it is understood that, in actual practice, two tubes similar to tubes 66*a* and 66*b* in the illustration of FIGS. 5 and 6 will extend between the two tubes of the respective wall portions, and that the crossover circuitry 64 will interconnect corresponding pairs of alternate tubes from two wall portions, with the number of tubes 66 provided depending on the number of tubes 24 in each wall portion. It is also understood that the additional crossover circuitry 68 is provided for the other alternate tubes at a level slightly above that of the crossover circuitry 66 as explained above.

Since the crossover circuitry 64 provided for the rear wall 18 is identical to that for wall 16 the former circuitry is not depicted in FIG. 7.

As also shown in FIG. 7, the sidewall 22 is provided with five sections—22*a*, 22*b*, 22*c*, 22*d* and 22*e*, each of which are shown slightly separated in the drawing for the purpose of illustration only. The sidewall 22 is provided with crossover circuitry 64 connecting various sections of the sidewall with other sections thereof in a manner similar to that described in connection with the front wall 16. The crossover circuitry 64 includes a plurality of crossover tubes, shown schematically by a single tube 70 in FIG. 7 which respectively interconnect alternating tubes of an end section 22*a* with corresponding alternating tubes of the right-hand portion of the central section 22*c* as viewed in the drawings. Also, a plurality of crossover tubes, represented by a single tube 72, respectively interconnect alternating tubes of the right end section 22*e* with corresponding alternating tubes of the left side portion of the central section 22*c*. As in the case of the wall 16, it is understood that in actual practice two crossover tubes 70 or 72 will interconnect each pair of tubes in the wall portions and that the other alternating tubes of the foregoing sections of the wall 22 will be connected by the crossover circuitry 68 at a level slightly above the level of the tubes 70 and 72.

It is noted from FIG. 7 that the wall sections 22*b* and 22*d* which extend between the center section 22*c* and the end section 22*a*, and between the center section 22*c* and the other end section 22*e*, respectively, are not provided with crossover circuitry for reasons to be explained in detail later.

Although not shown in FIG. 7, it is understood that the sidewall 20 is sectioned and provided with crossover circuitry in a manner identical to that of the sidewall 22.

Figure 8:
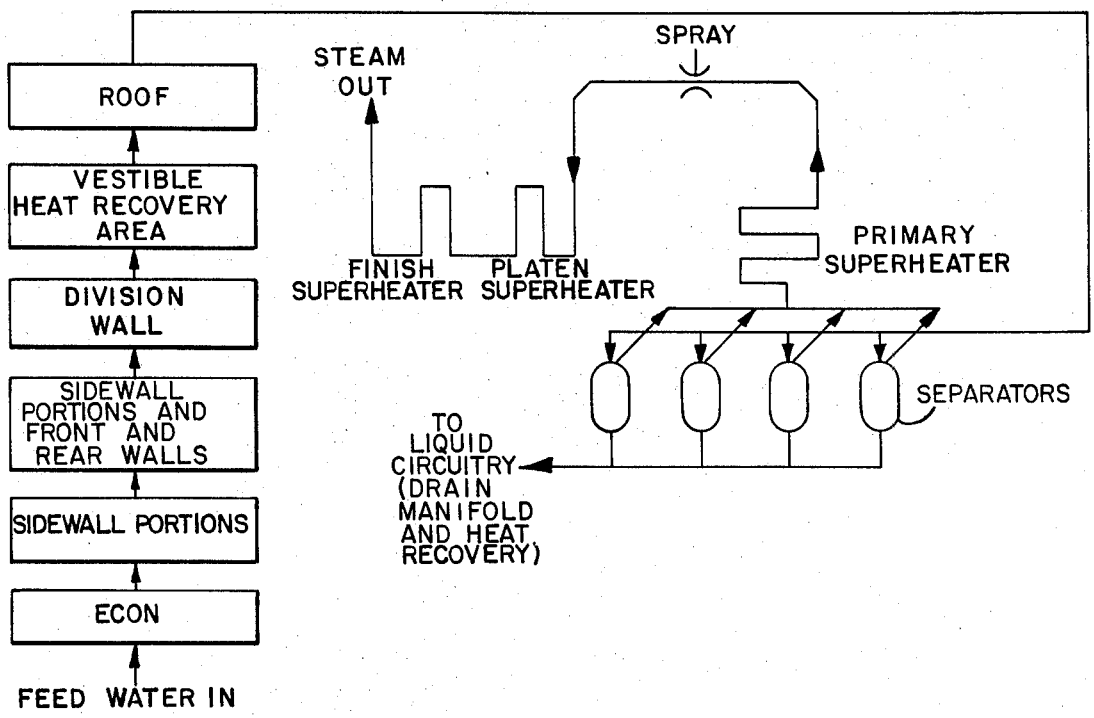
FIG. 8 is a schematic diagram depicting the entire flow circuit of the vapor generator of the present invention.

The operation of the vapor generator of the present invention will be described in connection with FIG. 8. In particular, feed water from an external source is passed through the economizer 50 to raise the temperature of the water before it is passed to inlet headers associated with the lower ends of sections 22*b* and 22*d* of the sidewall 22 and corresponding sections (not referenced) of the sidewall 20. All of the water flows upwardly and simultaneously through the latter wall sections to raise the temperature of the water before it is collected in suitable headers located at the upper ends of these sections. The fluid is then passed downwardly through suitable downcomers or the like and then to appropriate inlet headers located at the lower ends of the tubes forming the walls 16 and 18, the portions 22*a*, 22*c*, and 22*e* of the wall 22 and the portions 20*a*, 20*c* and 20*e* of the wall 20. The water flows upwardly and simultaneously through the walls 16 and 18, the wall portions 20*a*, 20*c*, 20*e*, and the wall portions 22*a*, 22*c* and 22*e* until the fluid reaches the crossover circuitry 64 and 68 associated with the various walls. At this point the fluid from a particular wall portion is transferred from another wall portion having a different heat exposure as discussed above, to correct for heat unbalances after which the fluid is again passed upwardly and simultaneously through the remaining portions of the walls 16 and 18 and the wall portions 20*a*, 20*c*, 20*e*, 22*a*, 22*c* and 22*e*, before it is collected in suitable headers located at the upper end of the upper furnace section 12.

The fluid is then passed downwardly through suitable downcomers or the like and then upwardly through the division walls 58 to add additional heat to the fluid. The fluid is then directed through the walls 40, 41, 42 and 44 of the heat recovery area 30 after which it is collected and passed through the roof 80. From the roof 80, the fluid is passed via a suitable collection of headers or the like, to the separators 84 which for on line operation off the start-up system, transfer the fluid directly to the primary superheater 52. From the latter, the fluid is spray attemperated after which it is passed to the platen superheater 56 and the finishing superheater 57 before it is passed in a dry vapor state to a turbine, or the like.

Figure 9:
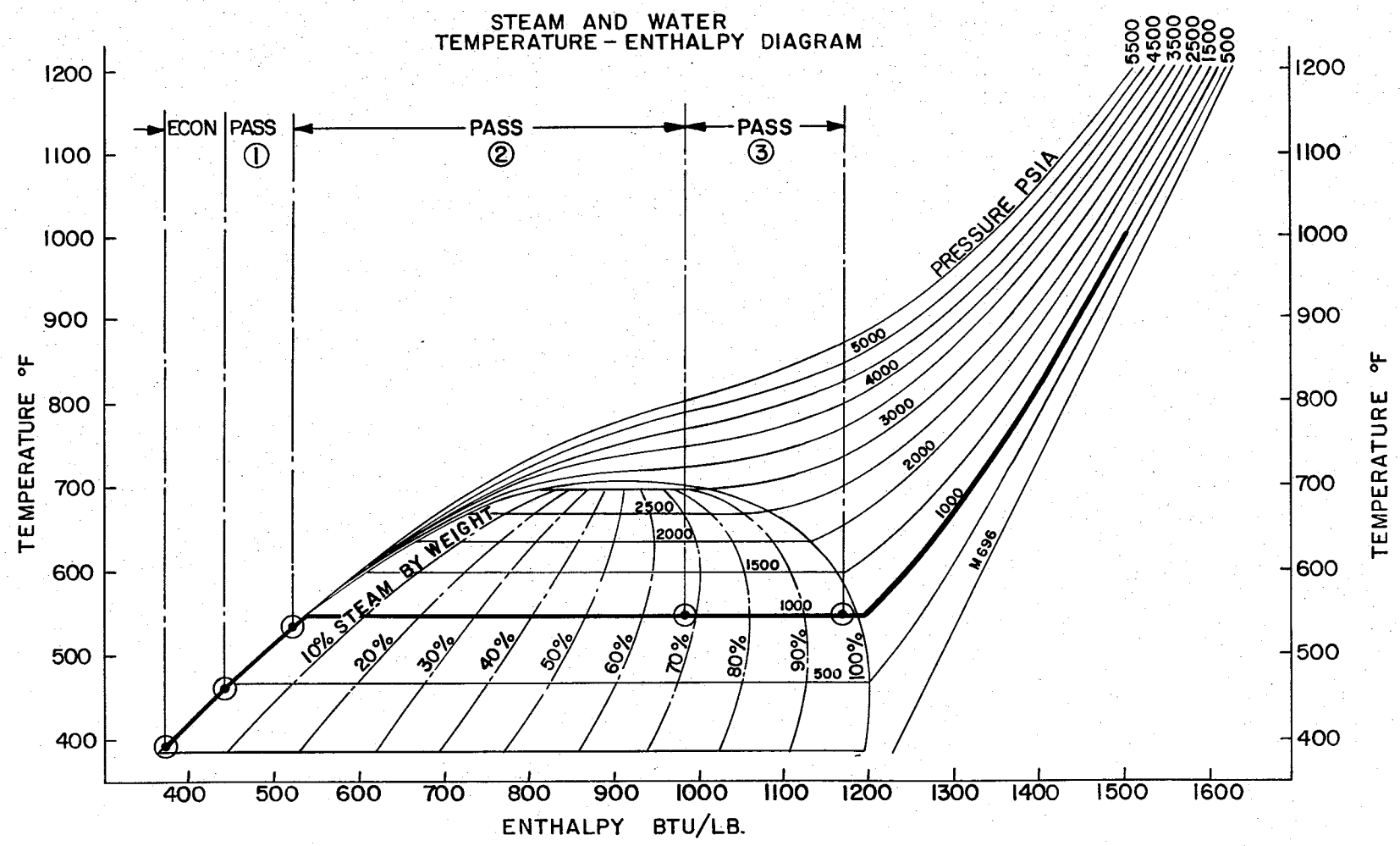
FIGS. 9 and 10 are graphic representations depicting the temperature enthalpy curve for a typical operation of the vapor generator of the present invention at 25% load and at maximum capacity rating, respectively.
Figure 10:
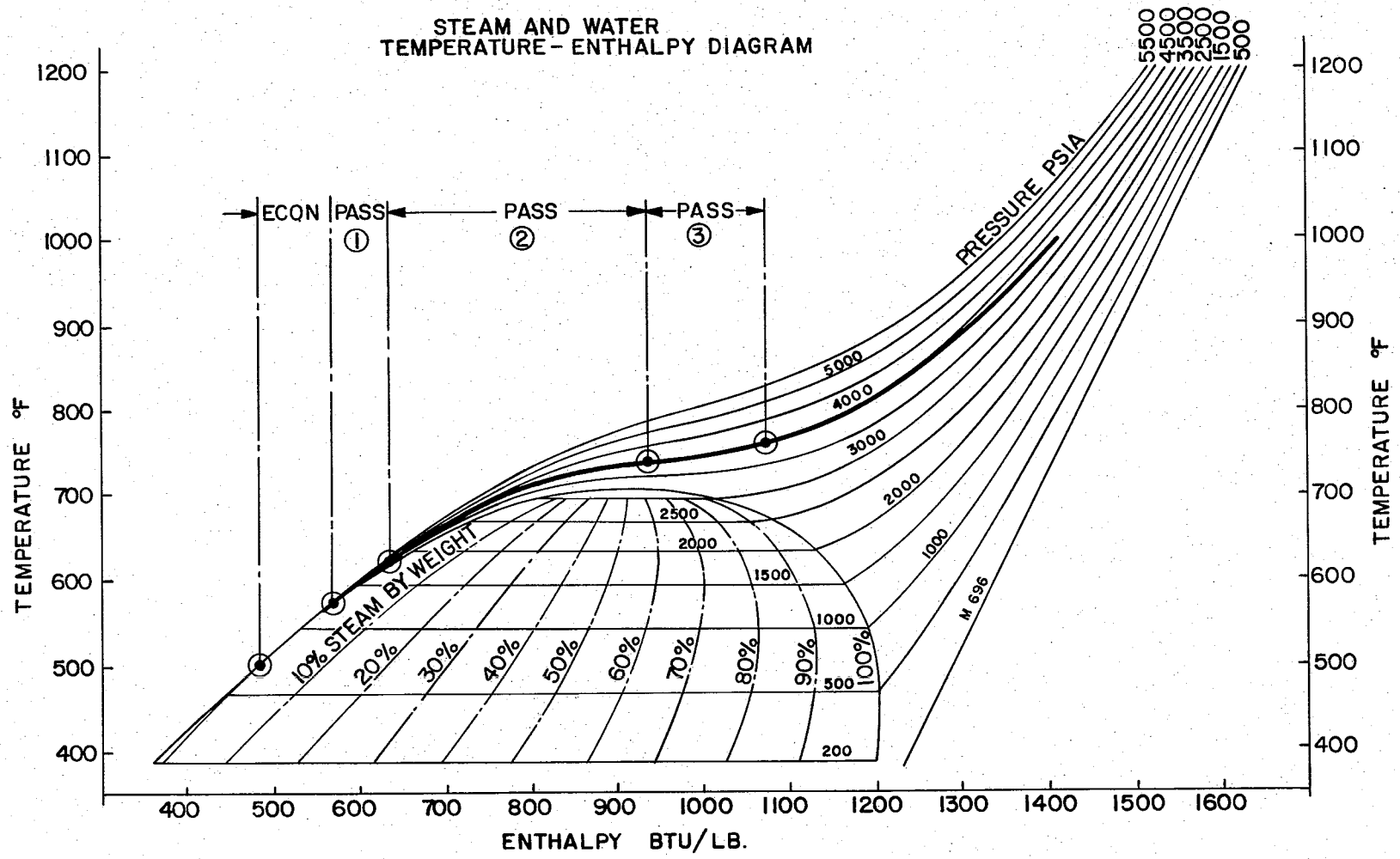

The temperature-enthalpy curves for a typical operation utilizing the vapor generator of the present invention as shown in FIG. 9 for a 25% load operation and in FIG. 10 for a maximum capacity rating (MCR) load. In particular, it is noted from FIG. 9 that, at 25% load, the water passing through the first pass (excluding the pass to the economizer) consisting of the wall sections 20*b*, 20*d*, 22*b* and 22*d*, is maintained in a subcooled state at a constant pressure of 1,000 psi with the enthalpy pick-up being from an inlet of 440 to an outlet of 520 BTUs per pound. During the second pass through the other sections of the sidewalls 20 and 22 and the entire span of the walls 16 and 18, the water is converted to approximately 70% steam with an enthalpy pick-up from an inlet of 540 BTUs per pound to an outlet of 985 BTUs per pound at a constant pressure of 1,000 psi. Referring to FIG. 10, at MCR load the fluid is supercritical at a pressure level of about 4,000 psi. The enthalpy pick-up in the first pass is from 570 to 630 BTUs per pound while the pick-up in the second pass is from 603 to 935 BTUs per pound. The design of the economizer 50 and the first pass of the furnace is such to insure a single phase fluid entering the second furnace pass.

Several advantages result from the foregoing. In particular, the water cooled first pass for the entire vertical length of the sidewall portions 20*b*, 20*d*, 22*b* and 22*d* of a fairly narrow width span limits the fluid enthalpy increase so as to provide a single phase fluid to the succeeding second furnace pass.

In this manner, the problem of evenly feeding a mixture of steam and water to the second furnace pass is avoided. The single phase fluid is passed simultaneously through the front wall 16, the rear wall 18 and the remaining portions of the sidewalls 20 and 22 resulting in a relatively large enthalpy pick-up, the conversion of the fluid to steam, and the correction of heat unbalances across the various wall spans by the crossover circuitry 64 and 68.

It is further understood that portions of the vapor generator have been omitted for the convenience of presentation. For example, insulation and support systems can be provided that extend around the boundary walls of the vapor generator as discussed above and a windbox, or the like, may be provided around the burners 28 to supply the air to same in a conventional manner. It is also understood that the upper end portions of the tubes 24 forming the upper furnace section 16 and heat recovery area 30 can be hung from a location above the vapor generating section 10 to accommodate thermal expansion in a conventional manner.

A latitude of modification, change and substitution is intended in the foregoing disclosure and in some instances same features of the invention will be employed without a corresponding use of other features. Accordingly, it is appropriate that the appended claims be construed broadly and in a manner consistent with the spirit and scope of the invention herein.

What is claimed is:

1. A vapor generator comprising an enclosure defined in part by a front wall, a rear wall and two sidewalls, each of said walls comprising a plurality of interconnected tubes; burner means associated with either said front wall, said rear wall or both; each of said sidewalls having a plurality of sections; means for passing fluid initially through the entire length of at least one of said sidewall sections and then through said front wall, said rear wall and the other sidewall sections; and crossover means associated with said front wall, said rear wall and said other sidewall sections for transferring said fluid from one area of said front wall, said rear wall and said other sidewall sections to another area thereof.

2. The vapor generator of claim 1, wherein said fluid is simultaneously passed through said one sidewall section and is simultaneously passed through said front wall, said rear wall and the other sidewall sections.

3. The vapor generator of claim 1, wherein each of said sidewalls has two end sections, a central section and two intermediate sections extending between said central section and a corresponding end section, said fluid being initially passed through the entire length of said intermediate sections and then through said end sections and said central section.

4. The vapor generator of claim 3, wherein said fluid is simultaneously passed through the entire length of said intermediate sidewall sections and then through said front wall, said rear wall, said end sidewall sections and said central sidewall sections.

5. The vapor generator of claim 4, wherein said fluid is in the form of water during its passage through said intermediate sidewall section and is converted to steam during its passage through said front wall, said rear wall, said end sidewall sections and said central sidewall section.

6. The vapor generator of claim 1, wherein said fluid passing means comprises headers associated with the lower and upper ends of said walls and fluid transfer pipes connected to said headers.

* * * * *